US008905513B2

(12) United States Patent
Ichinowatari

(10) Patent No.: US 8,905,513 B2
(45) Date of Patent: Dec. 9, 2014

(54) IMAGE FORMING APPARATUS

(71) Applicant: Jun Ichinowatari, Kanagawa (JP)

(72) Inventor: Jun Ichinowatari, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/059,623

(22) Filed: Oct. 22, 2013

(65) Prior Publication Data

US 2014/0132663 A1 May 15, 2014

(30) Foreign Application Priority Data

Nov. 15, 2012 (JP) ..... 2012-250780

(51) Int. Cl.
*B41J 2/015* (2006.01)
*B41J 2/165* (2006.01)
*B41J 23/02* (2006.01)

(52) U.S. Cl.
CPC ..... *B41J 2/16547* (2013.01); *B41J 23/025* (2013.01)
USPC ..... 347/22

(58) Field of Classification Search
CPC .... B41J 2/16511; B41J 2/16547; B41J 2/165; B41J 23/02; B41J 23/025; B41J 2002/16576; B41J 2002/16582
USPC ..... 347/22
See application file for complete search history.

(56) References Cited

U.S. PATENT DOCUMENTS

| | | | | |
|---|---|---|---|---|
| 7,984,958 | B2 * | 7/2011 | Koga et al. | 347/16 |
| 2007/0048058 | A1 * | 3/2007 | Koga et al. | 400/283 |
| 2007/0057447 | A1 * | 3/2007 | Asada et al. | 271/272 |
| 2011/0050816 | A1 | 3/2011 | Katoh et al. | |
| 2011/0134184 | A1 | 6/2011 | Katoh et al. | |
| 2011/0141167 | A1 | 6/2011 | Kikkawa et al. | |
| 2013/0187985 | A1 | 7/2013 | Katoh et al. | |

FOREIGN PATENT DOCUMENTS

| | | |
|---|---|---|
| JP | 2005-144912 | 6/2005 |
| JP | 2009-034832 | 2/2009 |

* cited by examiner

*Primary Examiner* — Alessandro Amari
*Assistant Examiner* — Michael Konczal
(74) *Attorney, Agent, or Firm* — Cooper & Dunham LLP

(57) ABSTRACT

An image forming apparatus including a recording head having a nozzle to discharge droplets; a reciprocally moving carriage on which the recording head is mounted; a rotary conveyance body disposed opposite the recording head and configured to convey a recording medium; a maintenance unit to maintain an optimal state of the recording head; and a drive transmission unit to transmit rotation of the rotary conveyance body to the maintenance unit. The drive transmission unit includes a drive transmission gear to drive the maintenance unit; and a gear moving unit. The gear moving unit includes moving means to move the drive transmission gear at the connection position; and a retainer to retain a state in which the drive transmission gear is moved to the connection position, even though the carriage is moved toward a second direction opposite the first direction.

3 Claims, 15 Drawing Sheets

IMAGE FORMING APPARATUS

CROSS-REFERENCE TO RELATED APPLICATION

The present application claims priority pursuant to 35 U.S.C. §119 from Japanese patent application number 2012-250780, filed on Nov. 15, 2012, the entire disclosure of which is incorporated by reference herein.

BACKGROUND

1. Technical Field

The present invention relates to an image forming apparatus.

2. Related Art

As an image forming apparatus such as a printer, a facsimile machine, a copier, a plotter, and a multifunction apparatus combining several of the capabilities of the above devices, for example, an inkjet recording apparatus is known that includes a print head to discharge ink droplets and performs printing by discharging droplets onto a recording medium.

Such an image forming apparatus includes a maintenance unit to clean and maintain performance of the recording head. The maintenance unit includes a cap to seal nozzles of the recording head, a suction pump to suck air in the cap, and a wiping member to wipe clean the nozzle surface, such as a wiper or a wiper blade. To drive the cap and the wiper included in the maintenance unit, a drive force of a drive source for a conveyance device to convey a recording medium is transmitted to the maintenance unit.

Conventionally, output power from a plurality of drive sources is transmitted to each of a plurality of driven members, as follows: a first switchover gear driven to rotate based on the output from a first drive source; a second switchover gear driven to rotate based on the output from a second drive source; a plurality of transmission gears disposed in parallel to each other, engageable with either the first switchover gear or the second switchover gear, and to transmit drive force to each of the plurality of driven members; a drive shaft to support the first switchover gear and the second switchover gear to slide in a predetermined direction in which a carriage moves reciprocally; a positioning device to selectively position the first switchover gear and the second switchover gear at any position among a plurality of drive force transmission positions corresponding to the transmission gear to slide the carriage in the predetermined direction n which the carriages moves reciprocally and thereby change a drive force transmission position of the first and second switchover gears; and a biasing member to elastically bias the positioning device along the predetermined direction which the carriage moves reciprocally.

Conceivably, an arrangement is possible in which moving the carriage moves a position of the drive force transmission gear so that a single drive source transmits the drive force to the recording medium conveyance means during image formation and to the maintenance unit during maintenance.

In this case, however, if the drive force can be transmitted to the maintenance unit only when the carriage remains stationary on the maintenance unit, waste liquid attached to the wiper cannot be cleaned by a cleaning member after the head surface has been wiped.

Specifically, because the wiping is performed after the carriage is moved and the nozzle surface is moved relative to the wiper member, the carriage is separated from the maintenance unit after the wiping operation and the driving force cannot be transmitted to the cleaning member.

As described above, moving of the drive force transmission gear alone by the carriage cannot drive the cleaning member of the maintenance unit to clean the wiper member and thus another drive source is required, which complicates the structure and increases the size of the apparatus, resulting in a cost rise.

SUMMARY

The present invention provides an optimal image forming apparatus capable of transmitting the drive force to the maintenance unit even when the carriage is separated from the maintenance unit.

More specifically, the present invention provides an image forming apparatus that includes: a recording head having a nozzle configured to discharge droplets; a carriage moving reciprocally on which the recording head is mounted; a rotary conveyance body disposed opposite the recording head and configured to convey a recording medium; a maintenance unit to maintain and recover an optimal state of the recording head; and a drive transmission unit to transmit rotation of the rotary conveyance body to the maintenance unit. The drive transmission unit includes: a drive transmission gear movable between a connection position connecting a recovery gear to drive the maintenance unit and a release position in which connection to the recovery gear is released; and a gear moving unit configured to move the drive transmission gear between the connection position and the release position, and the gear moving unit includes: a coil spring and a lever to move the drive transmission gear at the connection position when the carriage is moved toward a first direction; and a retainer to retain a state in which the drive transmission gear is moved to the connection position, even though the carriage is moved toward a second direction opposite the first direction in a state in which the drive transmission gear has moved to the connection position.

These and other objects, features, and advantages of the present invention will become apparent upon consideration of the following description of the preferred embodiments of the present invention when taken in conjunction with the accompanying drawings.

DETAILED DESCRIPTION

Hereinafter, preferred embodiments of the present invention will now be described with reference to accompanying drawings.

Figure 1:
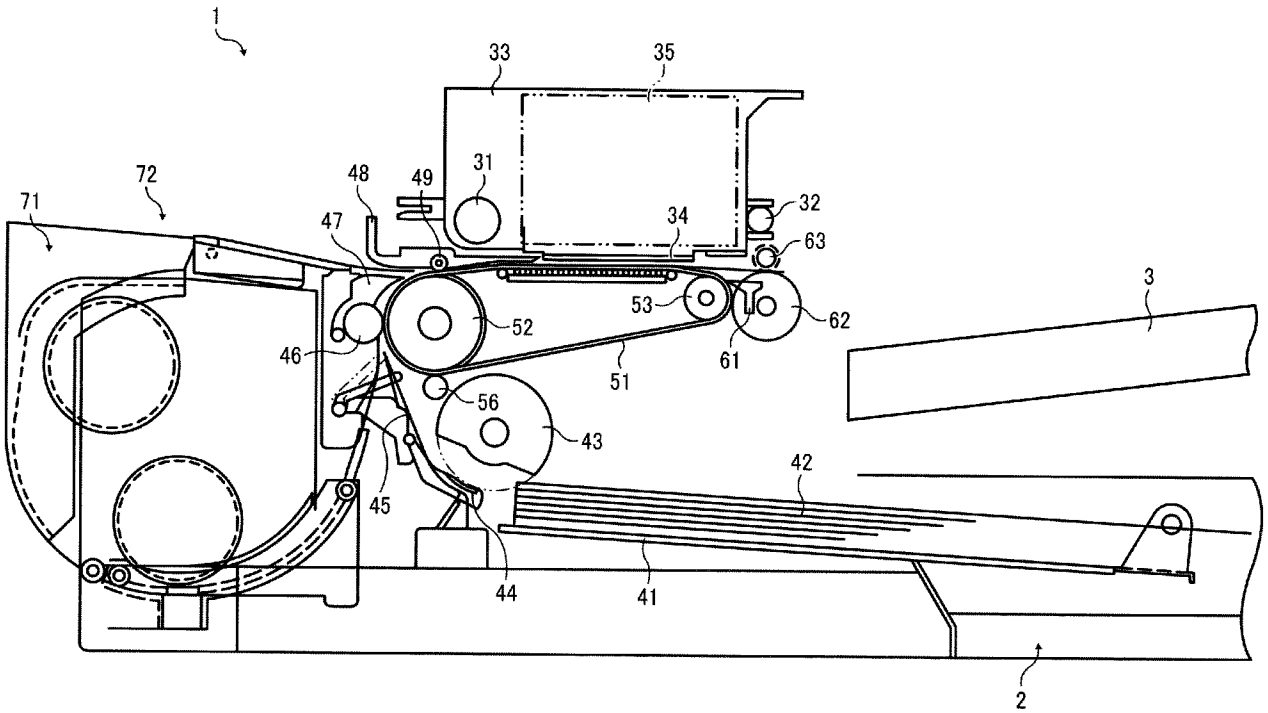
FIG. 1 is a schematic view of an image forming apparatus according to a first embodiment of the present invention.

First, an example of an image forming apparatus according to the present invention will be described with reference to FIGS. 1 and 2. FIG. 1 is a side view of the image forming apparatus illustrating a mechanical structure thereof, and FIG. 2 is a plan view illustrating the main part of the image forming apparatus of FIG. 1.

Figure 2:
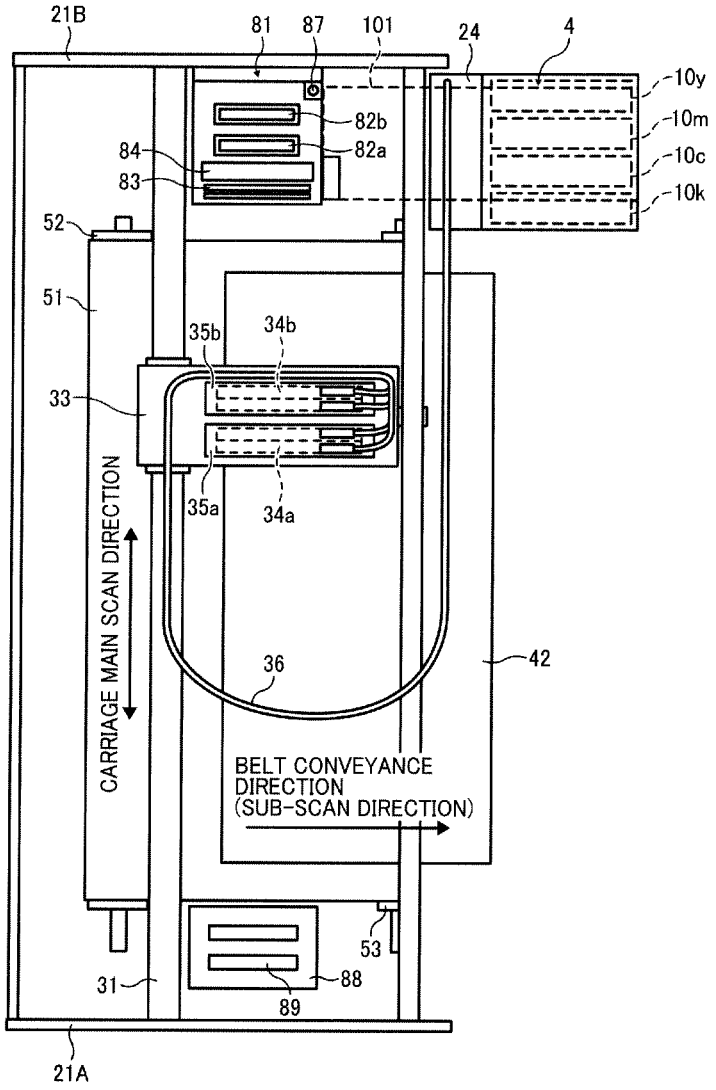
FIG. 2 is an explanatory plan view of a main part of the image forming apparatus of FIG. 1.

The image forming apparatus is a serial-type inkjet recording apparatus, including an apparatus main body 1, side plates 21A and 21B disposed at lateral sides of the main body 1, main and sub guide rods 31 and 32 horizontally mounted on the lateral side plates 21A and 21B, and a carriage 33 supported by and slidably movable along the guide rods 3*l* and 32 in a carriage main scanning direction indicated by an arrow in FIG. 2 by a main scanning motor, not shown, via a timing belt.

Recording heads 34*a* and 34*b* (collectively referred to as recording heads 34) are mounted on the carriage 33. The recording heads 34 are formed of liquid discharging heads to discharge ink droplets of yellow (Y), cyan (C), magenta (M), and black (K) colors, respectively.

The recording heads 34 include nozzle arrays formed of a plurality of nozzles arranged in a sub-scanning direction perpendicular to the main scanning direction, such that ink droplets are discharged downward.

More specifically, the recording heads 34 each include two nozzle arrays. One of the nozzle arrays of the recording head 34*a* discharges droplets of black (K) and the other discharges droplets of cyan (C) ink. One of the nozzle arrays of the recording head 34*b* discharges droplets of magenta (M) and the other discharges droplets of yellow (Y) ink, respectively.

The carriage 33 includes sub tanks 35*a* and 35*b* (collectively referred to as sub tanks 35) to supply ink of respective colors corresponding to each of the nozzle arrays of the recording heads 34. The sub tanks 35 are supplied with ink of respective colors by a supply pump unit 5 via a supply tube 36 for each color from ink cartridges 10*y*, 10*m*, 10*c*, and 10*k*, each of which is detachably mounted to a cartridge loading portion 4.

Additionally, there are provided a sheet feed tray 2; a sheet stack section 41; a crescent-shaped sheet feed roller 43 to separate each sheet 4 stacked on the sheet stack section 41 and convey it one by one; and a separation pad 44 opposite the sheet feed roller 43. The separation pad 44 is formed of a material having a high friction coefficient and is pressed against the sheet feed roller 43.

Then, in order to send the sheet 42 fed from the sheet feed section to the lower side of the print heads 34, a guide member 45 to guide the sheet 42, a counter roller 46, a conveyance guide member 47, and a pressing member 48 having an end press roller 49 are provided. In addition, a conveyance belt 51 serving as a conveyance means to electrostatically attract and convey the sheet 42 to a position opposed to the recording heads 34 is provided.

The conveyance belt 51 is an endless belt stretched over and around a conveyance roller 52 and a tension roller 53, and is configured to be rotatable in a belt conveyance direction (i.e., a sub-scanning direction). In addition, a charging roller 56, which is a charging means to charge a surface of the conveyance belt 51, is provided. The charging roller 56 is disposed in contact with the surface layer of the conveyance belt 51 and is rotatably driven by the rotation of the conveyance belt 51. The conveyance belt 51 is rotated in a belt conveyance direction by the rotation of the conveyance roller 52 timed by a sub-scanning motor, not shown.

Further, as a sheet ejection portion to eject the sheet 42 recorded by the recording heads 34, a separation pawl 61 to separate the sheet 42 from the conveyance belt 51, a sheet discharge roller 62, and a spur 63 being a sheet discharge roller are provided. A sheet discharge tray 3 is provided underneath the sheet discharge roller 62.

A detachable duplex unit 71 is provided at a backside of the apparatus body 1. This duplex unit 71 pulls in the sheet 42 which has been returned by a reverse rotation of the conveyance belt 51, reverses the sheet 42, and feeds the reversed sheet 42 again between the counter roller 46 and the conveyance belt 51. An upper surface of the duplex unit 71 is used as a manual sheet feed tray 72.

Further, as illustrated in FIG. 2, a maintenance unit 81 to clean the nozzles of the recording head 34 is disposed at a non-print area at one side in the scanning direction of the carriage 33. The maintenance unit 81 includes caps 82*a* and 82*b* (collectively, caps 82) to cap each nozzle face of the recording heads 34. The maintenance unit 81 further includes a wiper blade 83 as a wiping member to wipe the surface of the nozzle and a first dummy discharge receiver 84 to receive dummy-discharged droplets. Here, "dummy discharge" means a discharge of droplets to discharge congealed ink not used in a normal recording operation. Further, the maintenance unit 81 includes a carriage lock 87 to lock the carriage 33.

Further, as illustrated in FIG. 2, a second dummy-discharge receiver 88 is disposed at a non-print area at an opposite side in the scanning direction of the carriage 33. As described above, the second dummy-discharge receiver 88 receives droplets of recording liquid that have congealed during printing. The second dummy-discharge receiver 88 includes an opening 89 along the nozzle array direction of the recording head 34.

In the thus-configured image forming apparatus, the sheets 42 are separated and fed one by one from the sheet feed tray 2, the sheet 42 fed upward in a substantially vertical direction is guided by the guide member 45, and is conveyed while being sandwiched between the conveyance belt 51 and the counter roller 46. Further, a leading edge of the sheet 42 is guided by the conveyance guide member 37 and is pressed against the conveyance belt 51 by the end press roller 49, so that the conveyance direction of the sheet 42 is changed by approximately 90 degrees.

At that time, the conveyance belt 51 is charged with an alternating charge voltage pattern consisting of alternating positive and negative charges of predetermined width in the sub-scanning direction, which is a cyclic rotating direction of the conveyance belt 51. When the sheet 42 is fed on the thus-alternately-charged conveyance belt 51, the sheet 42 is attracted to the conveyance belt 51 and is conveyed in the sub-scanning direction by the cyclic rotation of the conveyance belt 51.

Then, the recording heads 34 are driven in response to image signals while the carriage 33 is moved to thus discharge ink droplets onto the stopped sheet 42 to record a single line. After the sheet 42 is conveyed a predetermined distance, a subsequent line is recorded. Upon receipt of a recording end signal or a signal indicating that a trailing edge of the sheet 42 has reached the recording area, the recording operation is terminated and the sheet 42 is discharged to the sheet discharge tray 3.

When maintenance of the recording heads 34 is performed, the carriage 33 is moved to a home position opposite the maintenance unit 81 and each nozzle face of the recording heads 34 is capped by the cap 82. Thereafter, maintenance operations such as suction of nozzles and dummy discharge, in which droplets not contributive to the image formation are discharged, are performed, thereby allowing continued formation of quality images with a stable droplet discharge.

Figure 3:
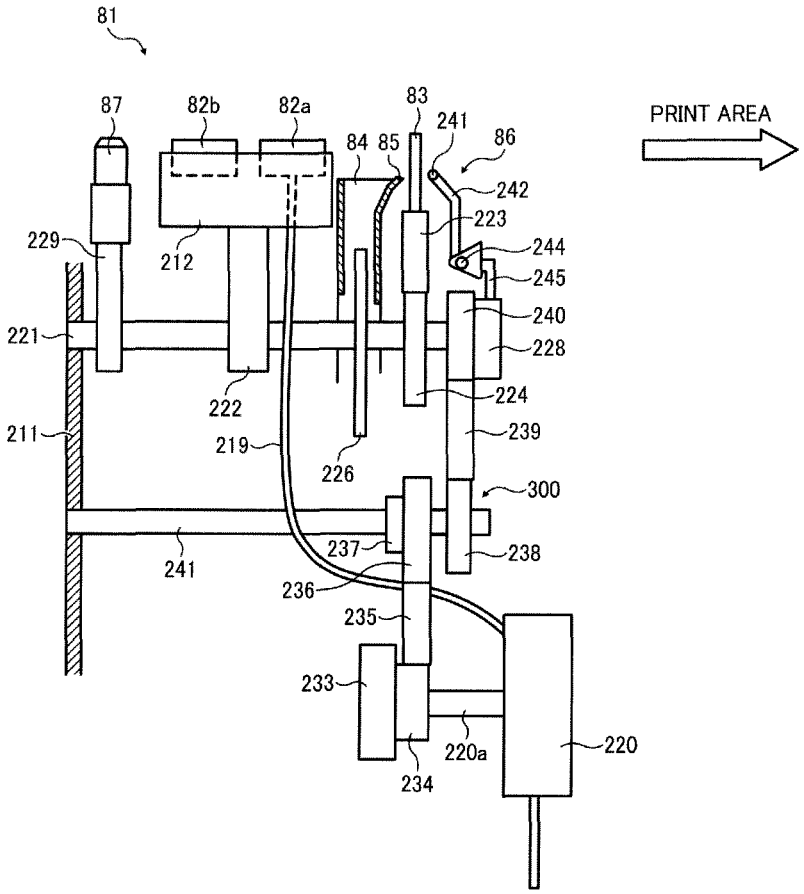
FIG. 3 is a schematic general view of a maintenance unit included in the image forming apparatus of FIG. 1.
Figure 4:
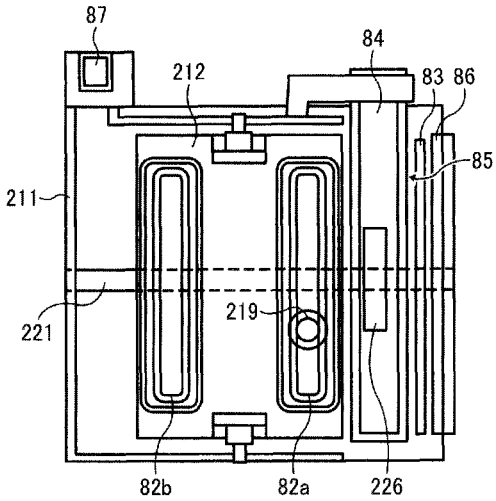
FIG. 4 is an explanatory plan view of the maintenance unit.

Next, the maintenance unit 81 included in the image forming apparatus will be described referring to FIGS. 3 and 4. FIG. 3 is a schematic general view of a maintenance unit; and FIG. 4 is a plan view illustrating the main part of the maintenance unit.

The maintenance unit 81 includes the caps 82*a* and 82*b* held by a cap holder 212, the wiper blade 83 held by a wiper holder 223, and a wiper cleaner 86 as a cleaning means, all of which are supported by a maintenance fame 211 to be vertically movable. Between the wiper blade 83 and the cap 82*a*, a cylindrical dummy-discharge receiver 84 is disposed.

A wiper scraper 85 to scrape the ink adhered on the wiper blade 83 is disposed on the dummy-discharge receiver 84 at a position facing the wiper blade 83.

To clean the wiper blade 83, the wiper blade 83 is pressed against and moved relative to the wiper scraper 85 by the wiper cleaner 86. That is, in this example, the wiper blade 83 is lowered. With this movement, the ink adhered to the wiper blade 83 is scraped off into the wiper scraper 85, and the scraped ink in the wiper scraper 85 is siphoned off by the suction pump 220, a suction means, to a waste liquid tank, not shown.

The wiper cleaner 86 includes a cleaner holder 242 and a cleaner roller 241 rotatably positioned at an upper end of the cleaner holder 242. The cleaner roller 241 contacts the wiper blade 83 so that the wiper blade 83 is pressed against the wiper scraper 85. The cleaner holder 242 is movably attached to the maintenance frame 211 via a support shaft 244 and is retracted to a retracted position via a tension spring, not shown, so as not to contact the wiper blade 83. A link member 245 is further provided to allow the cleaner holder 242 to oscillate.

A tubing pump 220 is communicated with the cap 82*a*, which is nearest to the printing area, via a flexible tube 219 formed of elastic materials. With this structure, the cap 82*a* alone is used as a suction and moisture-retention cap and the cap 82*b* is used as a moisture-retention cap only. Accordingly, in the maintenance of the recording heads 34, the target recording head 34 for the maintenance is selectively moved to a capping position by the cap 82*a* having a suction capability.

The suction pump 220 repeatedly gives a pressure to move the suction tube 219 via a plurality of pressurizing members to cause the tube 219 to generate suction force.

A cam shaft 221 rotatably supported by the maintenance frame 211 is disposed below the caps 82*a* and 82*b* and the wiper blade 83. A cap cam 222 to move the cap holder 212 vertically and a wiper cam 224 to move the wiper blade 83 vertically are disposed on the cam shaft 221. Further, the maintenance unit 81 includes a roller 226 to receive dummy-discharged droplets in the dummy-discharge receiver 84, a cleaner cam 228 to oscillate the wiper cleaner 86, and a carriage lock cam 229 to vertically move the carriage lock 87.

As described later, a driving force of the conveyance roller 52 is transmitted to a recovery gear 233 via the drive transmission unit 300, so that the suction pump 220 and the cam shaft 221 rotate.

Further disposed are intermediate gears 234, 235, 238, and 239, an intermediate gear 236 having a one-way clutch 237, and a cam gear 240. The intermediate gear 234 integral with the recovery gear 233 engages the intermediate gear 236 having a one-way clutch 237 via the intermediate gear 235. The intermediate gear 238 coaxial with the intermediate gear 236 engages with the cam gear 240 fixed at the cam shaft 221 via the intermediate gear 239. The intermediate gear 236 having a one-way clutch 237 and an intermediate shaft 241 being a rotary shaft of the intermediate gear 238 are rotatably supported by the maintenance frame 211.

Next, a first embodiment according to the present invention will be described with reference to FIGS. 5 through 7.

Figure 5:
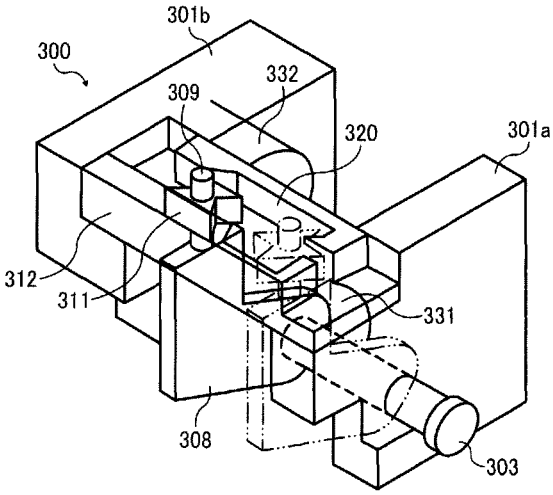
FIG. 5 is a perspective view illustrating a drive switchover unit as a rotary drive transmitter in the first embodiment of the present invention.

FIG. 5 is a perspective view illustrating a drive switchover unit as a rotary drive transmitter in the first embodiment of the present invention; FIG. 6 is an explanatory view illustrating relative positions of the drive switchover unit and the maintenance unit; and FIG. 7 is an explanatory view illustrating the drive switchover unit.

The drive switchover unit 300 is a rotary drive transmitter to transmit rotation of the conveyance roller 52 to the maintenance unit 81. The conveyance roller 52 rotates the conveyance belt 51 that conveys the sheet 42 at a position opposite the recording head 34.

The drive switchover unit 300 includes a drive transmission gear 331 disposed between a drive gear 332 mounted on a shaft 52*a* of the conveyance roller 52 and the recovery gear 233 of the maintenance unit 81. The drive transmission gear 331 is movably held on a shaft 303 extending between the frame members 301*a* and 301*b*. Because the shaft 303 is disposed along the main scanning direction, the drive transmission gear 331 also is movable in the main scanning direction.

The drive transmission gear 331 enters between the drive gear 332 and the recovery gear 233, thereby connecting the recovery gear 233 and transmitting the rotation of the drive gear 332 to the recovery gear 233. Further, when the drive transmission gear 331 separates from the drive gear 332 and the recovery gear 233, connection with the recovery gear 233 is released and the rotation of the drive gear 332 is not transmitted to the recovery gear 233.

Figure 6:
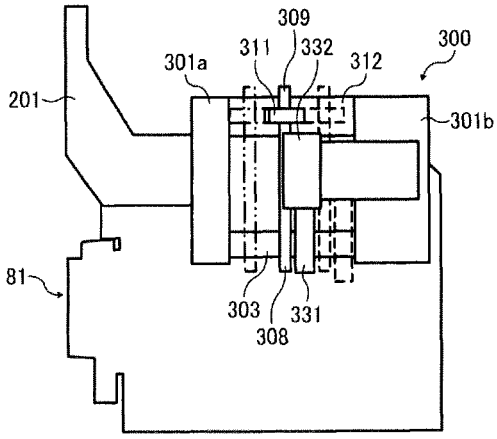
FIG. 6 is an explanatory view illustrating relative positions of the drive switchover unit and the maintenance unit.
Figure 7:
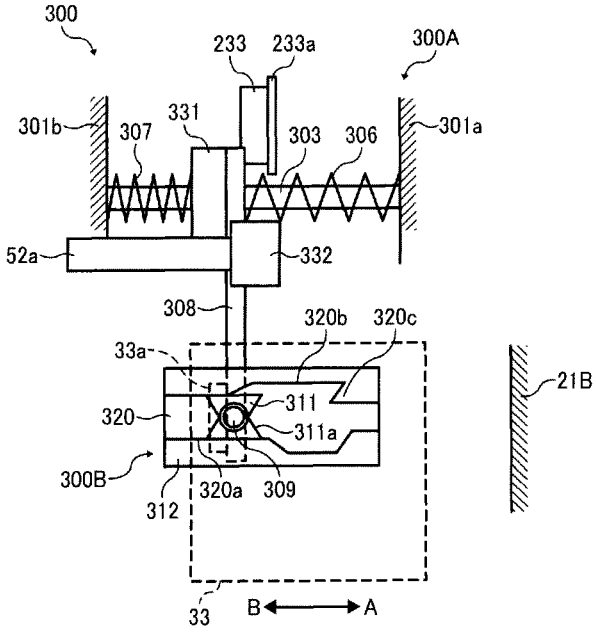
FIG. 7 is an explanatory view illustrating the drive switchover unit.

Specifically, the drive transmission gear 331 is movable in the main scanning direction between a position to connect to the recovery gear 233 of the maintenance unit 81 (that is, a position shown by a solid line in FIGS. 5 and 6) and a position to release connection with the recovery gear 233 (that is, a position shown by a broken line in FIGS. 5 and 6).

Then, when the carriage 33 moves toward a first direction, that is, in the main scanning direction, a gear moving unit 300A that is also included moves the drive transmission gear 331 between the connecting position and the release position.

Specifically, the gear moving unit 300A includes coil springs 306 and 307 which are elastic members that act to move the drive transmission gear 331 between the connection position and the release position along the shaft 303.

The coil spring 306 is disposed between the drive transmission gear 331 and the frame member 301*a* and exerts a restitutive force to press the drive transmission gear 331 in Arrow-B direction. The coil spring 307 is disposed between the drive transmission gear 331 and the frame member 301*b* and exerts a restitutive force to press the drive transmission gear 331 in Arrow-A direction.

Herein, a spring load of the coil spring 306 is greater than that of the coil spring 307. With this structure, when the drive transmission gear 331 receives restitutive force from the coil springs 306 and 307, the drive transmission gear 331 moves to the release position; when the drive transmission gear 331 does not receive restitutive force from the coil spring 306, the drive transmission gear 331 moves to the connection position due to the restitutive force of the coil spring 307.

A lever 308 that operates to compress the coil spring 306 when the carriage 33 moves in the first direction (that is, Arrow-A direction) so that the coil spring 306 is separated from the drive transmission gear 331, is disposed between the drive transmission gear 331 and the coil spring 306.

The lever 308 is movably held by the shaft 303 and provided with a projection 309, and a contact portion 33*a* at an upper portion of the carriage 33 contacts the projection 309. When the carriage 33 moves in the first Arrow-A direction, because the contact portion 33*a* of the carriage 33 contacts the projection 309, the lever 308 is pressed toward the first direction, which allows the drive transmission gear 331 to move to the connection position.

Specifically, that the carriage 33 is moved to the first direction by the coil springs 306 and 307 and the lever 308, forms a means to move the drive transmission gear 331 to the connection position.

Then, a retainer 300B serves to retain the lever 308 at the position to hold the drive transmission gear 331 that has moved to the connection position.

The retainer 300B includes a stopper 311 rotatably disposed at the projection 309 of the lever 308 and a guide member 312 on which a channel 320 is formed. The stopper 311 is movable along the channel 320.

The stopper 311 is disposed to be movable in the main scanning direction along the channel 320 of the guide member 312 which forms the part of frame of the drive switchover unit 300. The stopper 311 includes V-shaped notches 311*a* at both lateral ends of a quadrilateral member.

On the other hand, the channel 320 of the guide member 312 includes a groove portion 320*a* with which the stopper 311 engages in a state in which the notches 311*a* of the stopper 311 are positioned in the main scanning direction; and a groove portion 320*b* at which the stopper 311 becomes rotatable.

The channel 320 further includes a projection 320*c* at an opposite end in the main scanning direction of the groove portion 320*a*. When the notch 311*a* of the stopper 311 contacts the projection 320*c*, the posture of the stopper 311 is changed to regulate a position of the lever 308. When the stopper 311 contacts the projection 320*c* again in such a posture capable of regulating the position of the lever 308, the stopper 311 returns to a posture to release a positional regulation of the lever 308.

Specifically, in the retainer 300B, when the position of the lever 308 is regulated and the drive transmission gear 331 moves to the connection position, even though the carriage 33 is moved to the second, Arrow-B direction opposite the first direction, the drive transmission gear 331 retains a state moved to the connection position.

Figure 8A:
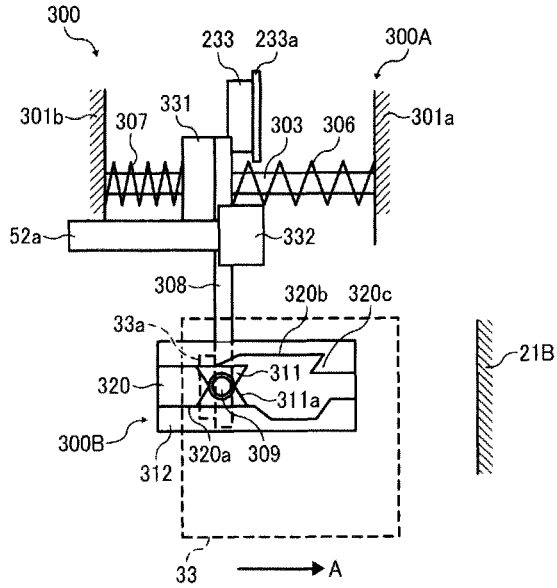
FIGS. 8A and 8B are schematic explanatory views each illustrating an operation of the drive switchover unit.

Next, the thus-configured operation of the rotary drive transmitter will be described with reference to FIGS. 8 through 10. FIGS. 8A to 10 are schematic explanatory views each illustrating an operation of the rotary drive transmitter.

First, FIG. 8A shows a state before drive transmission. In this case, because the lever 308 is pressed by the coil spring 306 against the drive transmission gear 331, the drive transmission gear 331 receives the restitutive force of the coil spring 306. As a result, the drive transmission gear 331 is pushed to Arrow-B direction opposite Arrow-A direction and is retained at the release position, where the restitutive force of the coil spring 306 and the restitutive force of the coil spring 307 are balanced.

As described above, the drive transmission gear 331 does not connect to either of the drive gear 332 and the recovery gear 233, so that the driving force is not transmitted to the maintenance unit 81 and the recovery gear 233 even when the conveyance roller 52 is rotated for printing. Further, the carriage 33 does not contact the lever 308 during printing.

From this state, when the carriage 33 moves in Arrow-A direction toward a right side plate 21B, the contact portion 33*a* of the carriage 33 as illustrated by a broken line in FIG. 8A contacts the projection 309 of the lever 308.

Figure 8B:
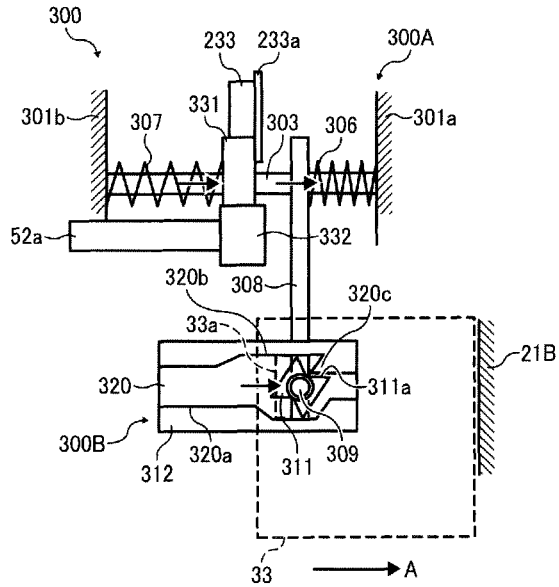

Then, when the carriage 33 further moves to Arrow-A direction, the lever 308 moves to Arrow-A direction as illustrated in FIG. 8B. Because the coil spring 306 is compressed by the moving of the lever 308, the restitutive force of the coil spring 306 does not affect the drive transmission gear 331.

Accordingly, the drive transmission gear 331 moves to the connection position in the same direction as Arrow A due to the restitutive force of the coil spring 307 and enters between the drive gear 332 and the recovery gear 233, thereby connecting the recovery gear 332, the recovery gear 233, and the drive transmission gear 331.

Because a flange 233*a* is formed on the Arrow-A direction edge surface of the recovery gear 233, if the drive transmission gear 331 contacts the flange 233*a*, the drive transmission gear 331 cannot move in Arrow-A direction anymore.

As described above, upon connection of the drive transmission gear 331 with the drive gear 332 and the recovery gear 233, the rotational force of the conveyance roller 52, being the force of the power source to drive the conveyance roller 52, can be transmitted to the maintenance unit 81.

Herein, when the carriage 33 further moves to Arrow-A direction, the lever 308 as well moves to Arrow-A direction. Then, as illustrated in FIG. 8B, the notch 311*a* of the stopper 311 strikes the projection 320*c* of the channel 320 of the guide member 312, so that the stopper 311 rotates by approximately 45 degrees. Specifically, the posture of the stopper 311 is changed to regulate the position of the lever 308.

Figure 9A:
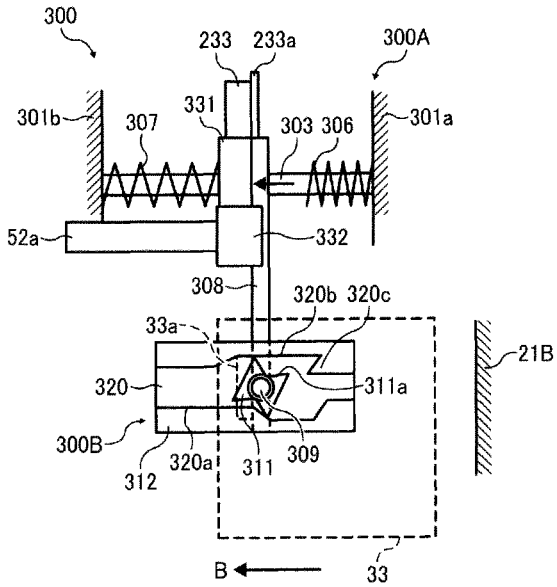
FIGS. 9A and 9B are schematic views following the operation in FIGS. 8A and 8B.
Figure 10:
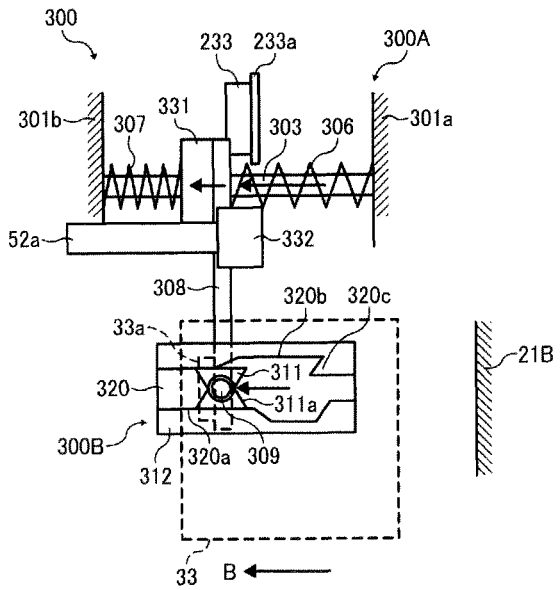
FIG. 10 is a schematic view following the operation in FIG. 9.

In this state, as illustrated in FIG. 9A, when the carriage 33 is further moved to Arrow-B direction, the lever 308 moves to Arrow-B direction due to the restitutive force of the coil spring 306. In this case, because the stopper 311 is rotated by approximately 45 degrees in its posture, the stopper 311 cannot move by rotating from the groove portion 320*b* to the groove portion 320*a* of the channel 320.

As a result, the lever 308 cannot move to Arrow-B direction either. It is to be noted that the position where the movement of the lever 308 toward Arrow-B direction is regulated is nearer to Arrow-A direction than the position where the lever 308 contacts the drive transmission gear 331 (more precisely, the position where the connection between the drive transmission gear 331 and the recovery gear 233 is not released).

Thus, even though the carriage 33 moves to Arrow-B direction or is separated from the maintenance unit 81, the restitutive force of the coil spring 306 does not affect the drive transmission gear 331 and the drive transmission gear 331 is retained at the connection position.

Figure 9B:
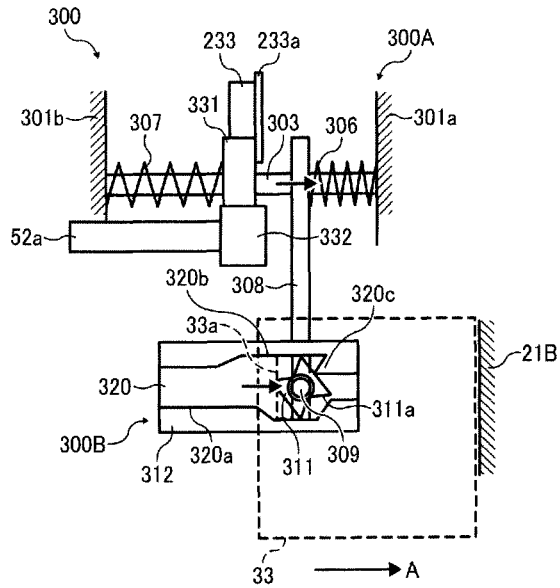

Next, to move the drive transmission gear 331 to the release position from this state, as illustrated in FIG. 9B, the carriage 33 is again moved to Arrow-A direction.

Then, as illustrated in FIG. 9B, the carriage 33 contacts the lever 308, the lever 308 moves to Arrow-A direction, and the stopper 311 moves to the groove portion 320*b* and becomes rotatable. Further, the carriage 33 moves to Arrow-A direction, so that the stopper 311 contacts the projection 320*c* of the guide member 312 and the posture of the stopper 311 rotates in a reverse direction by approximately 45 degrees.

As a result, the stopper 311 becomes rotatable along the periphery from the groove portion 320*b* to the groove portion 320*a* of the channel 320. Specifically, the posture of the stopper 311 is changed to release the positional regulation of the lever 308.

Accordingly, as illustrated in FIG. 10, by moving the carriage 33 to Arrow-B direction, when the lever 308 moves to Arrow-B direction due to the restitutive force of the coil spring 306, the stopper 311 enters into the groove portion 320*a* of the channel 320.

As a result, the lever 308 moves to Arrow-B direction due to the restitutive force of the coil spring 306 after contacting the drive transmission gear 331, and the drive transmission gear 331 is moved to the release position.

The above sequence needs to be performed in a space extending from a position at which the recording head 34 resides directly above the cap 82 to a position at which the carriage 33 contacts the right side plate 21B.

As described above, the gear moving unit is configured to include a means to move the drive transmission gear by the move of the carriage to the first direction; and, in a state in which the drive transmission gear is moved to the connection position, a retention means to maintain a state in which the drive transmission gear is moved to the connection position even though the carriage is moved in the second direction opposite the first direction, whereby the driving force can be transmitted to the maintenance unit even when the carriage is separated from the maintenance unit.

With this configuration, for example, after the nozzle surface of the head has been wiped, the waste liquid adhered on the wiper member can be removed by the cleaning member.

Figure 11:
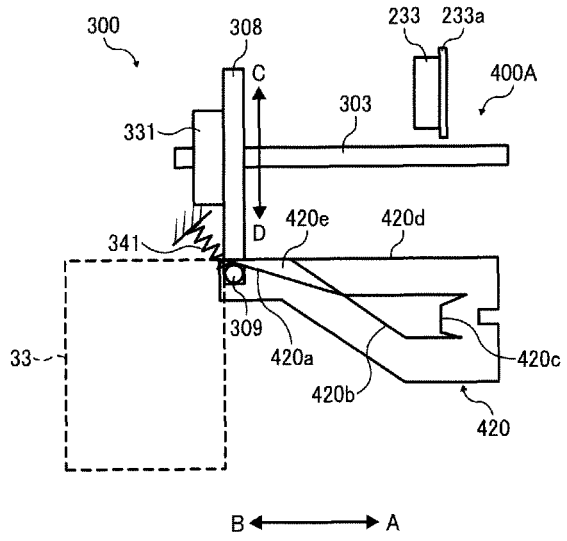
FIG. 11 is a schematic explanatory view illustrating a second embodiment of the present invention.

Next, a second embodiment of the present invention will be described referring to FIG. 11. FIG. 11 is a schematic explanatory view illustrating an operation of the rotary drive transmitter.

In the present second embodiment, a gear moving unit 400A includes a cam groove 420 serving as a retention means formed on a frame member, not shown. Then, the projection 309 of the lever 308 moves along the cam groove 420. The carriage 33 contacts the projection 309 and the projection 309 moves similarly to the first embodiment, accompanied by the movement of the carriage 33 in Arrow-A direction. In the present embodiment, the projection 309 is disposed on the bottom side of the lever 308 and the cam groove 420 is disposed below the lever 308 correspondingly.

Herein, the lever 308 includes a long slot at a portion where the lever 308 engages the shaft 303. The shaft 303 fits into the long slot so as to be vertically movable in Arrow-C direction and Arrow-D direction, thereby allowing the projection 309 of the lever 308 to move along the cam groove 420 as described above.

In addition, a tension spring 341 is disposed between the lever 308 and the frame member. The tension spring 341 biases the lever 308 in a direction such that the lever 308 simultaneously moves the drive transmission gear 331 to the release position and moves the projection 309 to press against the wall surface of the cam groove 420 toward the shaft 303.

Although not illustrated, a spring to press the drive transmission gear 331 toward the connection position with the recovery gear 233 is provided as well and functions similarly to the above-described spring 306.

Herein, the cam groove 420 has a substantially heart-shaped form and includes groove portions 420*a* to 420*d*. The groove portion 420*a* keeps the lever 308 at a position where the drive transmission gear 331 positions at the release position. The groove portion 420*b*, as a first groove, serves as a guide for the lever 308 to move in Arrow-A direction when the drive transmission gear 331 moves to the connection position.

The groove portion 420*c*, as a second groove, serves to regulate the position of the lever 308 when the lever 308 returns to Arrow-B direction, in a state in which the drive transmission gear 331 has moved to the connection position, so that the drive transmission gear 331 is retained at the connection position.

The groove portion 420*d*, as a third groove, guides the lever 308 to be detached from the groove portion 420*c* due to the restitutive force of the tension spring 341 and to return to Arrow-B direction, in a state in which the lever 308 is retained in the groove portion 420*c* and the lever 308 is moved again to Arrow-A direction and is moved to Arrow-B direction.

A slanted surface 420*e* is formed between a link portion between the groove portion 420*a* and the groove portion 420*b*, and the groove portion 420*d*. In this case, the slanted surface 420*e* has a slant higher at the slanted surface 420*d* side than the link portion between the groove portions 420*a* and 420*b*. With this structure, movement of the projection 309 from the groove portion 420*a* to the groove portion 420*d* is prevented.

Next, operation of the gear moving unit of the rotary drive transmitter will be described with reference to schematic explanatory FIGS. 12 to 14.

Figure 12A:
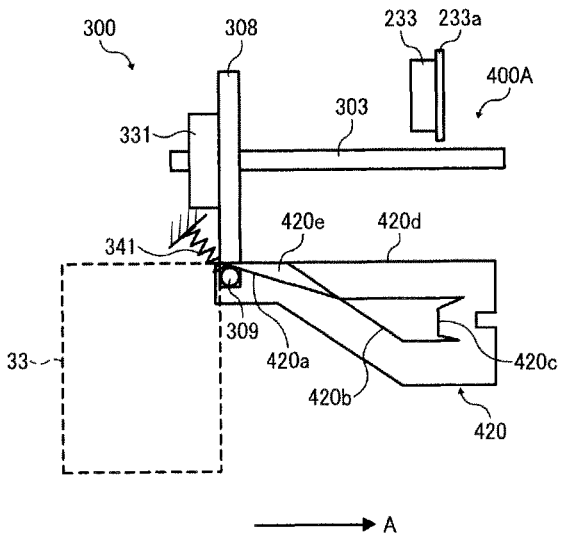
FIGS. 12A and 12B are schematic explanatory views each illustrating an operation of the drive transmitter according to the second embodiment of the present invention.

As illustrated in FIG. 12A, the carriage 33 is moved to Arrow-A direction from a state in which the drive transmission gear 331 is at the release position. Then, as illustrated in FIG. 12B, the lever 308 is pushed by the carriage 33 and the projection 309 is guided by the groove portion 420*b* of the cam groove 420 and moves in Arrow-A direction to reach a right support point of the cam groove 420.

As a result, the drive transmission gear 331 also moves to the connection position in Arrow-A direction and connects the recovery gear 233 and a drive gear of the conveyance roller, not shown. In addition, similarly to the first embodiment, further movement in Arrow-A direction of the drive transmission gear 331 is prevented by the flange 233*a* of the recovery gear 233.

In this state, as illustrated in FIG. 12A, when the carriage 33 is further moved to Arrow-B direction, the lever 308 moves to Arrow-B direction due to the restitutive force of the tension spring 341, engages the groove portion 420*c* and is retained therein. The position of the lever 308 in this case is set at a position to remain connected with the drive transmission gear 331, the recovery gear 233, and the drive gear 332, not shown, similarly to the first embodiment.

Figure 12B:
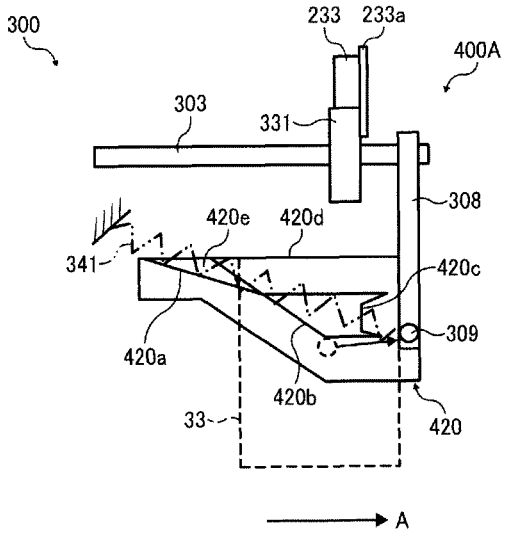

Then, as illustrated in FIG. 12B, when the carriage 33 is again moved to Arrow-A direction, the projection 309 of the lever 308 comes off from the groove portion 420*c* and reaches the right support point of the cam groove 420.

Figure 13A:
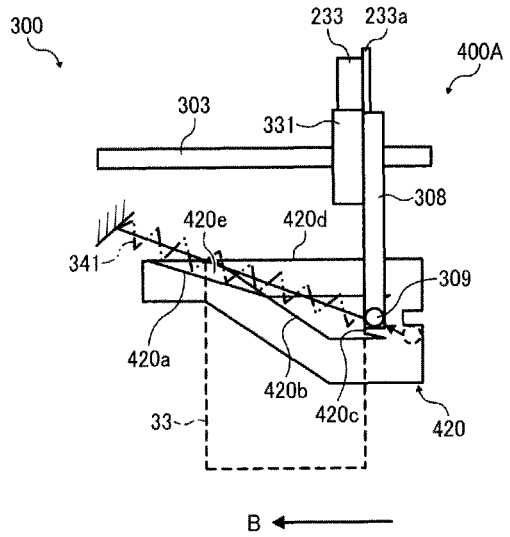
FIGS. 13A and 13B are schematic views following the operation in FIGS. 12A and 12B.

Accordingly, as illustrated in FIG. 13, by moving the carriage 33 to Arrow-A direction, the projection 309 of the lever 308 moves along the groove portion 420*d* in arrow-B direction and slides down the slanted surface 420*e*, thereby returning to a first release position (free position).

Figure 13B:
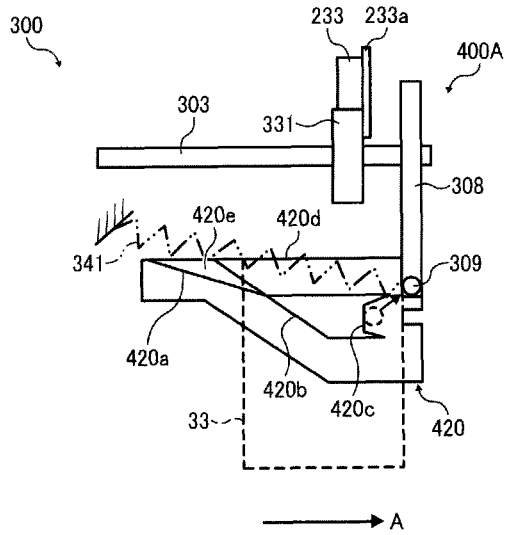
Figure 14:
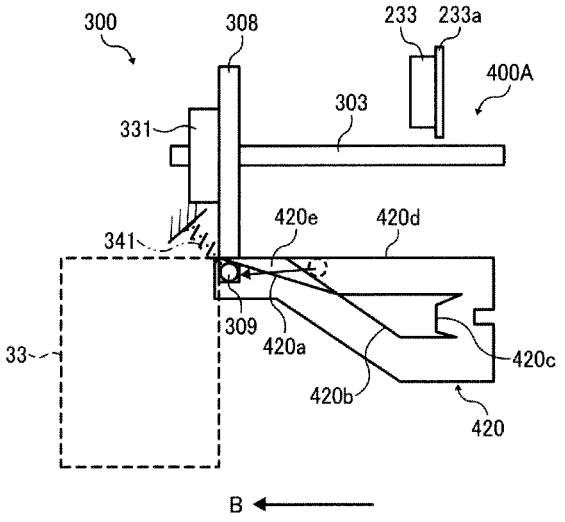
FIG. 14 is a schematic view following the operation in FIGS. 13A and 13B.

It is to be noted that, when the carriage 33 moves in Arrow-A direction, the state of FIG. 12A does not shift to the state of FIG. 13B due to the slanted surface 420*e*.

The above sequence needs to be performed in a space from the position at which the recording head 34 resides directly above the cap 82 to the position at which the carriage 33 contacts the right side plate 21B.

Figure 15:
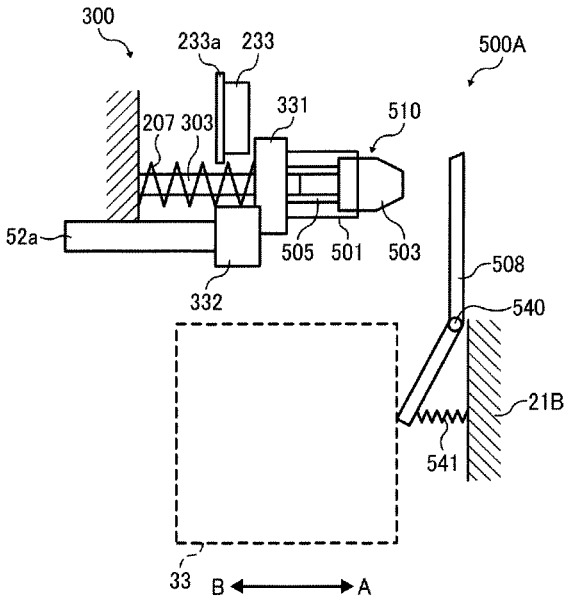
FIG. 15 is a schematic explanatory view illustrating a third embodiment of the present invention.

Next, a third embodiment according to the present invention will be described with reference to FIGS. 15 and 16. FIG. 15 is a cross-sectional view illustrating the third embodiment; and FIG. 16 is a cross-sectional view illustrating a latch unit in the third embodiment.

In the third embodiment, a gear moving unit 500A includes a lever 508 and a latch unit 510. When the carriage 33 is moved toward the first direction, the lever 508 is pushed and displaces, operating the latch unit 510.

The latch unit 510 is pushed by the lever 508 and moves the drive transmission gear 331 to the connection position and retains the state in which the drive transmission gear 331 is moved to the connection position even though the carriage 33 is moved toward the second direction and the lever 508 is separated.

Figure 16:
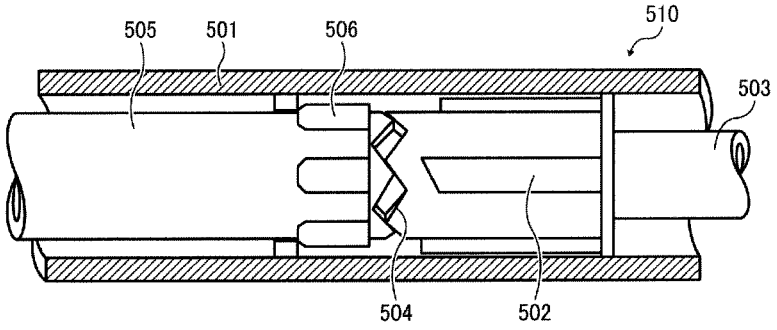
FIG. 16 is a cross-sectional view illustrating an example of a latch mechanism in the third embodiment.

As illustrated in FIG. 16, the latch unit 510 includes a cylinder-shaped holder 501 including a pawl member 502; and a knocking member 503 including a tooth-shaped member 504 at one end in the holder 501. The latch unit 510 further includes a rotary member 505 with a tooth-shaped member 506 inside the knocking member 503.

The pawl member 502 of the holder 501 has the same number of guide grooves as the number of the teeth of the tooth-shaped member 506 of the rotary member 505, so that the tooth-shaped member 506 of the rotary member 505 engages and is stopped by the guide grooves at the same number of upper points and lower points.

In addition, the tooth-shaped member 504 of the knocking member 503 includes double the number of teeth of the pawl member 502 of the holder 501 and the tooth-shaped member 506 of the rotary member 505.

On the other hand, the lever 508 is swingably supported by a shaft 540 on the right side plate 21B. A first end of the lever 508 faces the knocking member 503 and a second end thereof is disposed at a position where the carriage 33 contacts.

Then, a compression spring 541 is disposed between the second end of the lever 508 and the right side plate 21B. The compression spring 541 applies pressure to the second end of the lever 508 so that the first end of the lever 508 separates from the knocking member 503 of the latch unit 510.

In addition, the drive transmission gear 331 is pressed toward the release position constantly by a coil spring 207 and the latch unit 510 is in a state contacting the holder 501. In this release position, the drive transmission gear 331 connects to the drive gear 332, but does not connect to the recovery gear 233.

Next, operation of the gear moving unit will be described with reference to FIGS. 17 and 18. FIGS. 17 and 18 are schematic explanatory views.

Figure 17A:
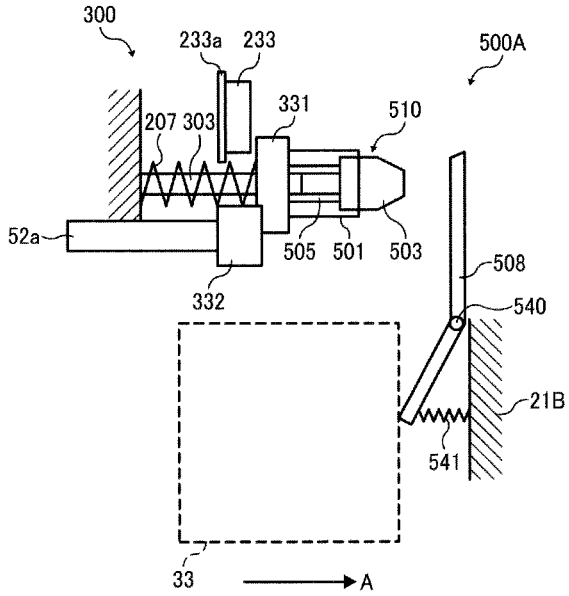
FIGS. 17A and 17B are schematic explanatory views each illustrating an operation of the rotary drive transmitter according to the third embodiment of the present invention.
Figure 18:
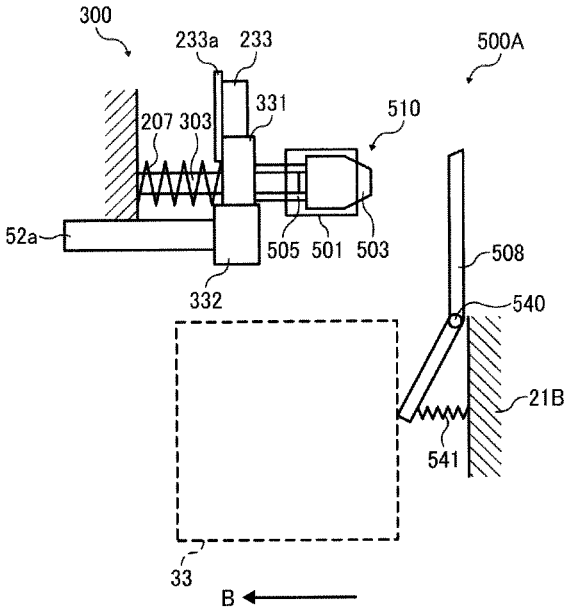
FIG. 18 is a schematic view following the operation in FIGS. 17A and 17B.

In a state before connection as illustrated in FIG. 17A, the drive transmission gear 331 is pushed toward the release position, and connects to the drive gear 331, but does not connect to the recovery gear 233.

Accordingly, if the printing is performed in this state, the rotation of the conveyance roller 52 is not transmitted to the maintenance unit 81. Further, the carriage 33 does not contact the lever 508 during printing.

Figure 17B:
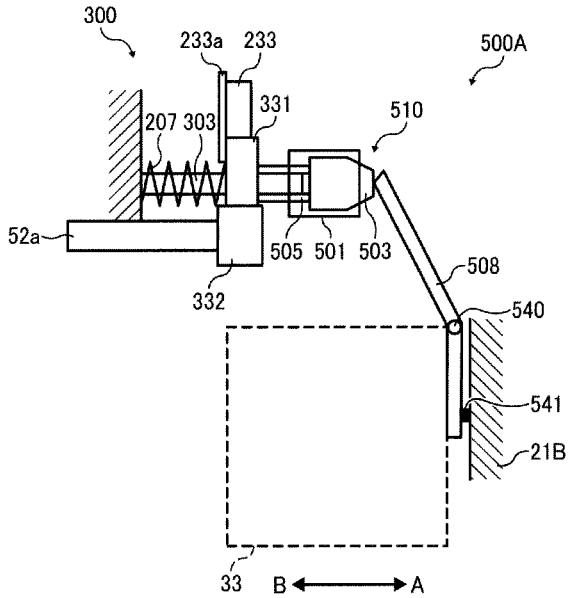

From the above state, when the carriage 33 is moved toward Arrow-A direction as illustrated in FIG. 17B, the carriage 33 contacts the lever 508 and the second end of the lever 508 is pushed toward the right side plate 21B.

With this operation, the lever 508 pivots around the shaft 540, and the first end of the lever 508 pushes the knocking member 503 of the latch unit 510 leftward in Arrow-B direction. In this case, the tooth-shaped member 504 of the knocking member 503 contacts the tooth-shaped member 506 of the rotary member 505 and the rotary member 505 moves leftward along the guide groove of the holder 501. When the rotary member 505 moves in Arrow-B direction more than the guide groove, the tooth-shaped member 506 of the rotary member 505 rotates along a slant of the tooth-shaped member 504 of the knocking member 503.

Thus, when the rotary member 505 of the latch unit 510 displaces toward Arrow-B direction, the drive transmission gear 331 moves to the connection position and connects the recovery gear 233 and the drive gear of a conveyance roller, not shown. In addition, similarly to the first embodiment, further movement in Arrow-B direction of the drive transmission gear 331 is prevented by the flange 233*a* of the recovery gear 233.

In addition, as shown in FIG. 16, the position where the rotary member 505 positions leftmost is the position where the rotary member 505 positions on the left of the guide groove. Then, the drive transmission gear 331 that contacts the rotary member 505 and moves to Arrow-B direction, contacts the flange 233*a* of the recovery gear 233 as described above, and is maintained to connect to the drive gear 332 and the recovery gear 233.

From this state, as illustrated in FIG. 18, when the carriage 33 is moved to Arrow-B direction, the lever 508 becomes separated from the knocking member 503 of the latch unit 510 due to the restitutive force of the compression spring 541.

In this case, in the latch unit 510, the tooth-shaped member 506 of the knocking member 505 is latched at the upper point via the guide groove of the holder 501, and, the knocking member 503, the rotary member 505, and the drive transmission gear 331 remain connected each at a position slightly deviated toward Arrow-A direction.

Thus, the drive transmission gear 331, the drive gear 332, and the recovery gear 233 all connected position or state is retained.

The above sequence needs to be performed in a space from the position at which the recording head 34 resides directly above the cap 82 to the position at which the carriage 33 contacts the right side plate 21B.

Figure 19B:
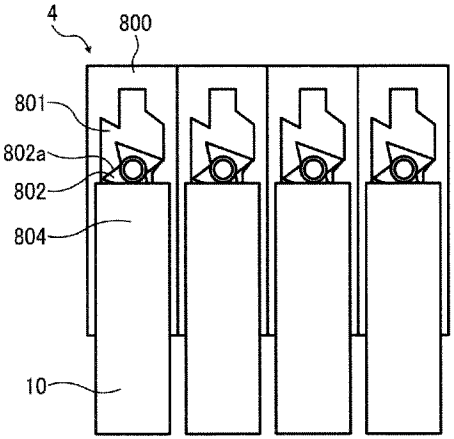
FIGS. 19A and 19B are explanatory views in which the first embodiment of the present invention is applied to a cartridge loading portion.
Figure 19A:
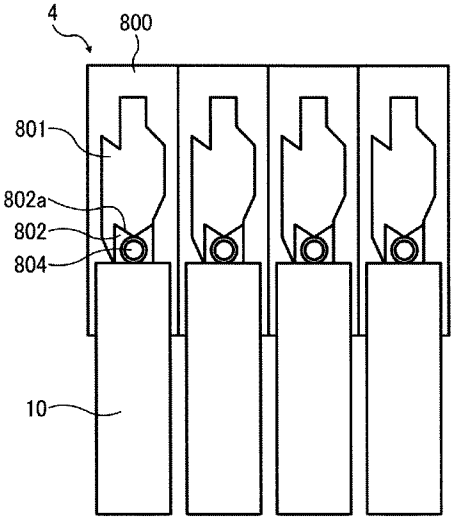

Next, referring to FIGS. 19A and 19B, an example in which the first embodiment of the present invention is applied to a cartridge loading portion will be described. FIGS. 19A and 19B are explanatory views illustrating how to apply the present invention to the cartridge loading portion 4.

The cartridge loading portion 4 includes a holder 800 into which each ink cartridge 10 is inserted. In addition, a recessed portion 801 is formed on each surface of the cartridge loading portion 4. A rotary cam 802 configured similarly to the stopper 311 in the first embodiment is movably disposed in the recessed portion 801.

A vertically slidable member, not shown, is disposed inside the recessed portion 801. A protrusion 804 of the slidable member is inserted into a hole of the rotary cam 802, so that the rotary cam 802 is rotatable. A tension coil spring, not shown, is connected to the protrusion 804 of the slidable member and a constant tensile state downward in the figure is kept.

With this structure, as illustrated in FIG. 19A, when the ink cartridge 10 is loaded on the cartridge loading portion 4, the ink cartridge 10 and the protrusion 804 contact each other and the ink cartridge 10 slidably moves upward along with the rotary cam 802 and the slidable member. Then, a peripheral edge of the rotary cam 802 contacts the recessed portion 801 of the cartridge loading portion 4, so that the rotary cam 802 is caused to rotate by 45 degrees.

Thereafter, when the push-in of the ink cartridge 10 is released, as illustrated in FIG. 19B, the ink cartridge 10, the rotary cam 802, and the slidable member is pushed back downward due to the force of the tension coil spring. In this case, because part of the recessed portion 801 enters into a notch 802*a* disposed on the rotary cam 802, the ink cartridge 10 does not move further downward.

When the ink cartridge 10 is pulled out from the cartridge loading portion 4, first, the ink cartridge 10 is again pushed upward in the figure. Then, the recessed portion 801 disengages from the notch 801*a* of the rotary cam 802, the ink cartridge 10 contacts again the recessed portion 801 at an uppermost position, so that the rotary cam 802 rotates.

Thereafter, when the push-in of the ink cartridge 10 is released, the ink cartridge 10, the rotary cam 802, and the slidable member are again pushed back downward due to the force of the tension coil spring, whereby the ink cartridge 10 can be pulled out easily.

In the present application, the term "sheet" is not limited to paper materials, but also includes an OHP sheet, fabrics, glass, board, and the like, on which ink droplets or other liquid can be adhered. The term "sheet" includes a recorded medium, recording medium, recording sheet, and the like. The term "image formation" means not only recording, but also printing, image printing, and the like.

The "image forming apparatus" means an apparatus to perform image formation by impacting ink droplets to various media such as paper, thread, fiber, fabric, leather, metals, plastics, glass, wood, ceramics, and the like. "Image formation" means not only forming images with letters or figures having meaning to the medium, but also forming images without meaning such as patterns to the medium (and simply impacting the droplets to the medium).

The "ink" is not limited to so-called ink, but means and is used as an inclusive term for every liquid such as recording liquid, fixing liquid, and aqueous fluid to be used for image formation, which further includes, for example, DNA samples, registration and pattern materials and resins.

The term "image" is not limited to a plane two-dimensional one, but also includes a three-dimensional one, and the image formed by three-dimensionally from the 3D figure itself.

Additional modifications and variations of the present invention are possible in light of the above teachings. It is therefore to be understood that, within the scope of the appended claims, the invention may be practiced other than as specifically described herein.

What is claimed is:

1. An image forming apparatus comprising:

a recording head having a nozzle configured to discharge droplets;

a carriage configured to move reciprocally, on which the recording head is mounted;

a rotary conveyance body disposed opposite the recording head and configured to convey a recording medium;

a maintenance unit for the recording head; and a drive transmission unit to transmit rotation of the rotary conveyance body to the maintenance unit, the drive transmission unit comprising:

a drive transmission gear movable between a connection position connecting a recovery gear to drive the maintenance unit and a release position at which connection to the recovery gear is released; and a gear moving unit configured to move the drive transmission gear between the connection position and the release position, the gear moving unit comprising:

moving means to move the drive transmission gear to the connection position when the carriage is moved in a first direction; and a retainer to retain the drive transmission gear at the connection position as the carriage is moved in a second direction opposite the first direction, wherein the moving means comprises a coil spring and a lever, wherein:

the lever is movable by the carriage when the carriage moves in the first direction, so that the drive transmission gear displaces to a position movable to the connection position; and the retainer regulates a position of the lever to retain the drive transmission gear at the connection position when the carriage moves to the second direction and releases the lever when the carriage moves again in the first direction and the lever is pressed, wherein the retainer comprises:

a stopper rotatably disposed on the lever; and a guide member including a groove portion along which the stopper can move, and wherein a posture of the stopper is changed to regulate a position of the lever at an end of the groove portion of the guide member when the carriage moves in the first direction, and the posture of the stopper is changed to release the positional regulation of the lever at the end of the groove portion of the guide member when the carriage again moves in the first direction.

2. An image forming apparatus comprising:

a recording head having a nozzle configured to discharge droplets;

a carriage configured to move reciprocally, on which the recording head is mounted;

a rotary conveyance body disposed opposite the recording head and configured to convey a recording medium;

a maintenance unit for the recording head; and a drive transmission unit to transmit rotation of the rotary conveyance body to the maintenance unit, the drive transmission unit comprising:

a drive transmission gear movable between a connection position connecting a recovery gear to drive the maintenance unit and a release position at which connection to the recovery gear is released; and a gear moving unit configured to move the drive transmission gear between the connection position and the release position, the gear moving unit comprising:

moving means to move the drive transmission gear to the connection position when the carriage is moved in a first direction; and a retainer to retain the drive transmission gear at the connection position as the carriage is moved in a second direction opposite the first direction, wherein the lever is movable by the carriage when the carriage moves in the first direction to displace the drive transmission gear to a position movable to the connection position, the gear moving unit further comprising:

a tension spring to bias the lever in the second direction; and a cam having a groove to engage a projection on the lever, comprising:

a first groove portion to guide the lever to move in the first direction when the carriage moves in the first direction;

a second groove portion continuous with the first groove portion to regulate the position of the lever so that the drive transmission gear is retained at the connection position when the carriage moves in the second direction and the lever moves in the second direction; and a third groove portion to guide the lever in the second direction when the carriage has again moved in the first direction and the lever is detached from the second groove portion.

3. An image forming apparatus comprising:

a recording head having a nozzle configured to discharge droplets;

a carriage configured to move reciprocally, on which the recording head is mounted;

a rotary conveyance body disposed opposite the recording head and configured to convey a recording medium;

a maintenance unit for the recording head; and a drive transmission unit to transmit rotation of the rotary conveyance body to the maintenance unit, the drive transmission unit comprising:

a drive transmission gear movable between a connection position connecting a recovery gear to drive the maintenance unit and a release position at which connection to the recovery gear is released; and a gear moving unit configured to move the drive transmission gear between the connection position and the release position, the gear moving unit comprising:

moving means to move the drive transmission gear to the connection position when the carriage is moved in a first direction; and a retainer to retain the drive transmission gear at the connection position as the carriage is moved in a second direction opposite the first direction, wherein the gear moving unit comprises:

a lever pushed and displaced when the carriage is moved in the first direction; and a latch unit pushed by the lever and configured to move the drive transmission gear to the connection position and retain the drive transmission gear at the connection position as the carriage is moved in the second direction and the lever separates from the latch unit.

* * * * *